US009833816B2

(12) United States Patent
Lopes et al.

(10) Patent No.: US 9,833,816 B2
(45) Date of Patent: Dec. 5, 2017

(54) APPARATUS FOR QUICKLY AND EFFICIENTLY CLEANING AND DISINFECTING SINK DRAINS AND SINK OVERFLOW HOLES

(71) Applicants: Robert John Lopes, Latrobe, PA (US); Kyle Leon Lopes, Latrobe, PA (US)

(72) Inventors: Robert John Lopes, Latrobe, PA (US); Kyle Leon Lopes, Latrobe, PA (US)

( * ) Notice: Subject to any disclaimer, the term of this patent is extended or adjusted under 35 U.S.C. 154(b) by 0 days.

(21) Appl. No.: 15/074,746

(22) Filed: Mar. 18, 2016

(65) Prior Publication Data

US 2016/0273209 A1 Sep. 22, 2016

Related U.S. Application Data

(60) Provisional application No. 62/177,572, filed on Mar. 19, 2015.

(51) Int. Cl.
*B08B 1/00* (2006.01)
*E03C 1/302* (2006.01)

(52) U.S. Cl.
CPC ..... *B08B 1/002* (2013.01); *E03C 1/302* (2013.01)

(58) Field of Classification Search
CPC combination set(s) only.
See application file for complete search history.

(56) References Cited

U.S. PATENT DOCUMENTS 285,771 A 9/1883 Turner
1,154,369 A * 9/1915 Browning ..... A46B 9/02 15/104.2
2,267,064 A 12/1941 Wikelund
2,283,780 A 5/1942 Ahern
2,315,673 A 4/1943 Taylor
2,630,593 A 3/1953 Jockers
2,726,417 A 12/1955 Rowser et al.
2,908,926 A 10/1959 Jockers
3,360,818 A 1/1968 Edwards
3,608,098 A 9/1971 Andrisani
4,846,599 A 7/1989 Seddon
4,858,360 A 8/1989 Hardin
4,894,948 A 1/1990 Eubanks
5,168,593 A * 12/1992 Poje ..... A46B 3/18 15/104.2
5,403,107 A 4/1995 Griffith et al.
5,497,514 A 3/1996 Miller
5,570,966 A 11/1996 Phelan
(Continued)

*Primary Examiner* — David Walczak

(74) *Attorney, Agent, or Firm* — Russ Weinzimmer & Associates, PC

(57) ABSTRACT

Apparatus for cleaning and disinfecting sink drains and overflow holes. The apparatus includes: a cleaning fluid dispenser having a cleaning fluid reservoir, and a dispensing mechanism with a fluid dispensing port. Cleaning fluid is forced from the cleaning fluid reservoir out via the fluid dispensing port. A flexible tube is attached to the fluid dispensing port, and a support wire is affixed at its proximal end to the inside of the fluid dispensing port. A cylindrical brush is attached to a distal end of the support wire, which runs inside the tube along its length from the dispensing port to the cylindrical brush, so the tube can provide cleaning fluid to the cylindrical brush. The flexible tube is durable under repeated use, sliding in and out of the overflow hole and the drain of a sink, while the wire prevents the tube from kinking.

14 Claims, 5 Drawing Sheets

(56) References Cited

U.S. PATENT DOCUMENTS

| | | | | |
|---|---|---|---|---|
| 6,058,524 | A | 5/2000 | Deveer | |
| 6,378,236 | B1 | 4/2002 | Solberg et al. | |
| 6,629,799 | B2 * | 10/2003 | Flores, Jr. | A47K 5/1202 15/104.92 |
| 7,194,773 | B2 * | 3/2007 | Bixby | E03D 9/00 4/255.01 |
| 7,232,310 | B2 | 6/2007 | Han et al. | |
| 7,699,608 | B2 | 4/2010 | Han et al. | |
| 8,657,518 | B2 | 2/2014 | Han | |
| 2007/0111158 | A1 | 5/2007 | Han et al. | |
| 2011/0179560 | A1 | 7/2011 | Beaumont | |
| 2012/0219350 | A1 | 8/2012 | Han | |
| 2014/0000019 | A1 | 1/2014 | Beaumont | |
| 2014/0123418 | A1 | 5/2014 | Han | |

* cited by examiner

APPARATUS FOR QUICKLY AND EFFICIENTLY CLEANING AND DISINFECTING SINK DRAINS AND SINK OVERFLOW HOLES

CROSS REFERENCE TO RELATED APPLICATIONS

This application has the priority date of the Provisional Patent Application Ser. No. 62/177,572 filed Mar. 19, 2015, and entitled: "E.O.C. (Easy Overflow Cleaner)", herein incorporated by reference in its entirety.

FIELD

This invention relates generally to devices for maintenance of sinks, and more particularly to devices for cleaning, unclogging, and disinfecting sinks.

BACKGROUND

Sinks in bathrooms rapidly accumulate hair, bacteria, soap residue, and other unsanitary matter. Although it's straightforward to clean such accumulated material from the exposed portions of the sink, such as the bowl, the counter top, etc, it is very difficult to clean the recessed and concealed portions of a sink, such as the drain, and the overflow hole near the top of the bowl.

Further, because the surfaces of the drain, the overflow hole, and the conduit that connects the overflow hole to the sink drain are not seen, and are not easily accessible for cleaning, such hidden surfaces tend to accumulate substantial amounts of unsanitary biomaterial, such as dead skin, hair, bacterial, fungus, mold, and viruses.

Many people do not have an understanding of the inner structure of sinks to know about such hidden unsanitary surfaces, and even people with such understanding cannot clean such surfaces with currently available equipment. Consequently, they are often compelled to call a plumber when the drain gets excessively clogged. However, because they are often unaware of the odor and disease breeding ground within the inner contours of many sinks, they often fail to even attempt to clean and disinfect the inner and typically inaccessible surfaces inside many sinks.

SUMMARY

A general aspect of the invention is an apparatus for quickly and efficiently cleaning and disinfecting sink drains and sink overflow holes. The apparatus includes: a cleaning fluid dispenser, the dispenser having a cleaning fluid reservoir, and a dispensing mechanism with a fluid dispensing port, operation of the dispensing mechanism resulting in cleaning fluid being forced from the cleaning fluid reservoir and out the fluid dispensing port; a tube sealed to and in fluid communication with the fluid dispensing port; and a support wire affixed at a proximal end to the fluid dispensing port, and having cylindrical brush extending from a distal end of the support wire, the support wire running inside the tube along its length from the dispensing port to the cylindrical brush, thereby being able to provide cleaning fluid to the cylindrical brush.

In some embodiments, the cleaning fluid dispenser having a suction cup for affixing the dispenser to a surface on or near the sink having the drains and overflow hole to be cleaned.

In some embodiments, the support wire is affixed at a proximal end to an inner surface of the fluid dispensing port.

In some embodiments, the cylindrical brush is rotatably attached to the distal end of the support wire.

In some embodiments, the cleaning fluid reservoir holds at least 30 oz of cleaning fluid.

In some embodiments, the cylindrical brush is reusable.

In some embodiments, the cylindrical brush has bristles suitable industrial use.

In some embodiments, the cylindrical brush is of a diameter slightly larger than the diameter of a sink overflow hole to be cleaned.

In some embodiments, the tube is flexible.

In some embodiments, the tube is longer than a distance within the sink from the overflow hole to the sink drain.

In some embodiments, the tube is made of a material that is durable under repeated use sliding in and out of the overflow hole and the drain of a sink.

In some embodiments, the wire is reinforced so as to prevent the wire from kinking while the tube is grasped and pushed into and pulled out of the overflow hole and the drain of a sink.

Another general aspect of the invention is an apparatus for quickly and efficiently cleaning and disinfecting sink drains and sink overflow holes. This apparatus includes: a squeezable cleaning fluid reservoir with a fluid dispensing port, squeezing of the dispensing mechanism resulting in cleaning fluid being forced from the cleaning fluid reservoir and out the fluid dispensing port; a flexible tube sealed to and in fluid communication with the fluid dispensing port; and a support wire affixed at a proximal end to an inner surface of the fluid dispensing port, and having a cylindrical brush rotatably attached to and extending from a distal end of the support wire, the support wire running inside the tube along its length from the dispensing port to the cylindrical brush, thereby being able to provide cleaning fluid to the cylindrical brush.

In some embodiments, the squeezable cleaning fluid dispenser has a suction cup for affixing the dispenser to a surface on or near the sink having the drains and overflow hole to be cleaned.

In some embodiments, the cleaning fluid reservoir holds at least 30 oz of cleaning fluid.

In some embodiments, the cylindrical brush is reusable and has bristles suitable industrial use.

In some embodiments, the cylindrical brush is of a diameter slightly larger than the diameter of a sink overflow hole to be cleaned.

In some embodiments, the flexible tube is longer than a distance within the sink from the overflow hole to the sink drain.

In some embodiments, the flexible tube is made of a material that is durable under repeated use sliding in and out of the overflow hole and the drain of a sink.

In some embodiments, the wire is reinforced so as to prevent the wire from kinking while the flexible tube is grasped and pushed into and pulled out of the overflow hole and the drain of a sink.

BRIEF DESCRIPTION OF THE DRAWINGS

For a fuller understanding of the invention, reference is made to the following Detailed Description, taken in conjunction with the accompanying drawings, in which.

DETAILED DESCRIPTION

Figure 1:
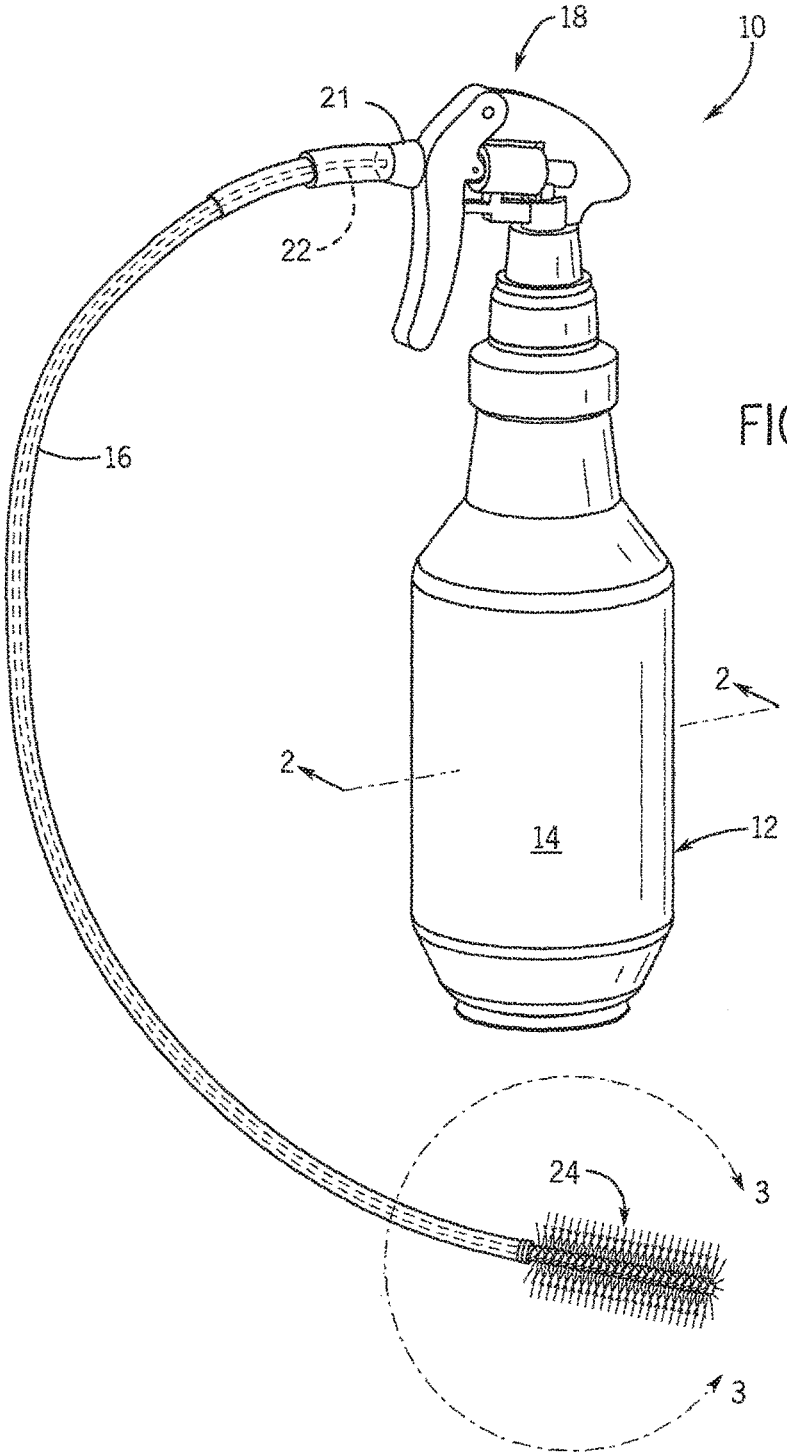
FIG. 1 is a front right side perspective view of the sink maintenance apparatus.
Figure 6:
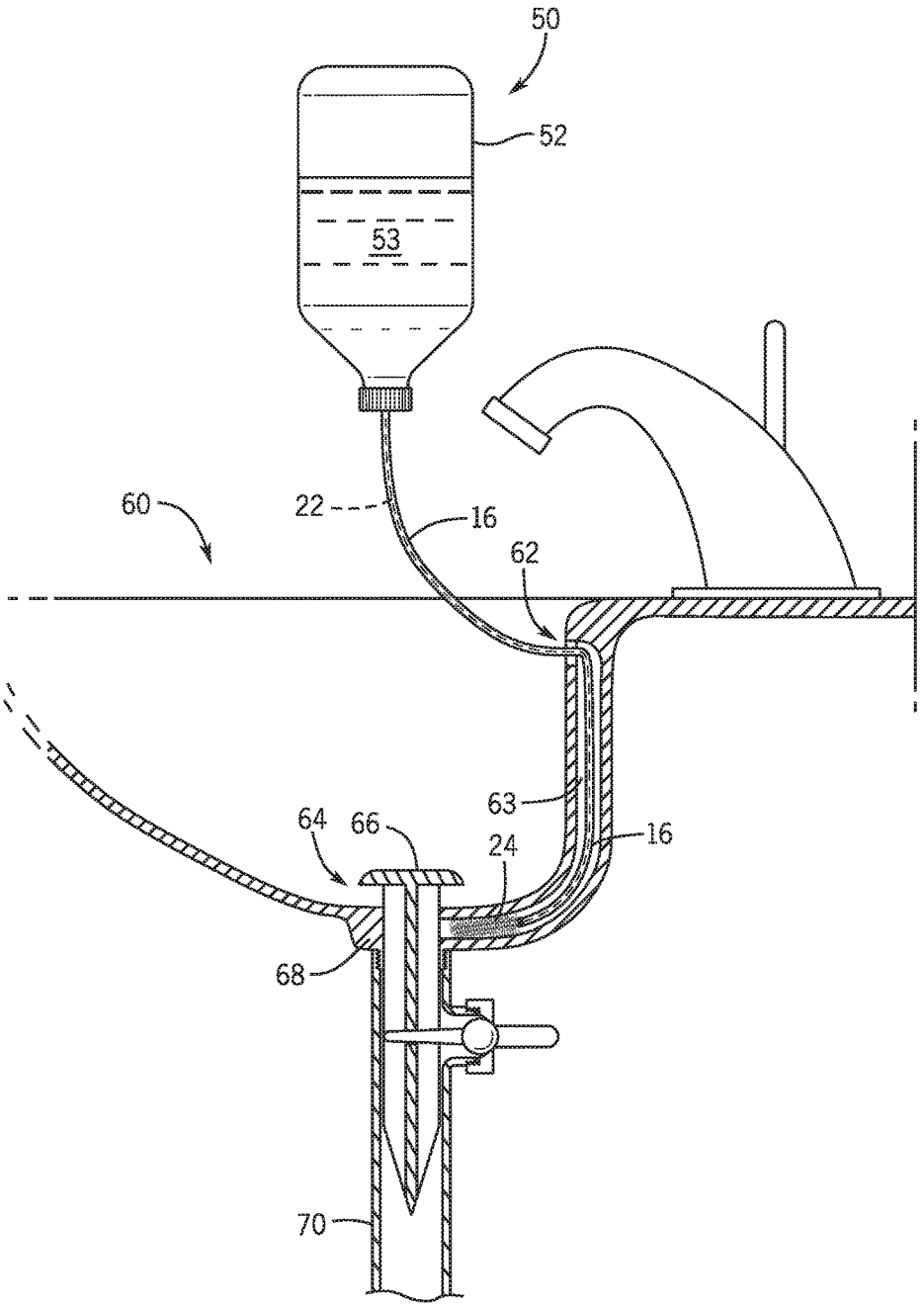
FIG. 6 is a side view of the embodiment of FIG. 5, where the distribution tube has been inserted into a sink overflow hole, and pushed downwards into the sink overflow until the cleaning brush reaches the drain popup assembly.

Referring to FIGS. 1 and 6, the device 10 or 50 enables the average home owner to clean and disinfect the overflow hole 62 and overflow channel 63 of a bathroom sink 60, and to clean and disinfect the pop-up assembly 64 of a bathroom sink 60, so as to keep the sink 60 free from accumulation of bacteria-causing sludge.

The cleaning brush 24 of the device 10 or 50 is adapted to be inserted into the sink overflow hole 62, and also into the drain 68 that is closed using the pop-up assembly 64. Then, the homeowner operates the pump mechanism 18 or squeezes the solution jug (squeezable reservoir) 52, which is filled with a cleanser of choice 14 or 53, so as to send the cleanser 14 or 53 through the distribution tube 16 to the soft bristle cleaning brush 24.

Then, the homeowner grasps the distribution tube 16 and pulls and pushes the cleaning brush 24 into and out of the overflow hole 62, and then into and out of the drain 68 past the pop-up assembly 64. Then, one can swab the overflow hole 62 and the drain 68 so as to clean up all of the sludge dislodged from the overflow hole 62 and the drain 68.

The device 10 or 50 can be inserted far down the drain 68 of the sink 60, past the pop up plug 66 of the popup assembly 64, so as to clean out the tail piece 70 below the pop up assembly 64.

Figure 2:
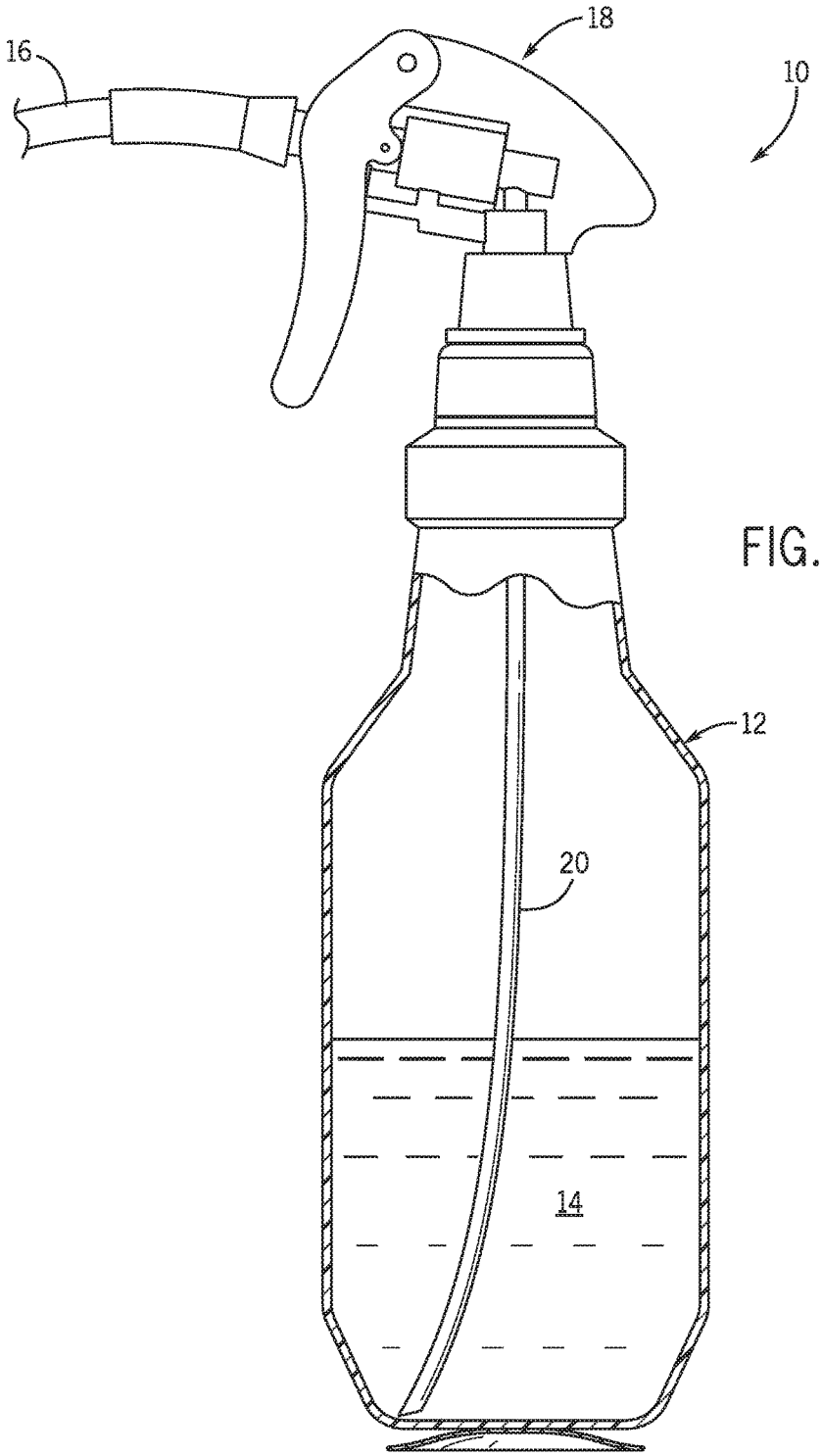
FIG. 2 is a right side view of the bottle portion of the sink maintenance apparatus of FIG. 1.

FIGS. 1 and 2 show an embodiment of the device 10 having a bottle (reservoir) 12 containing a cleaning solution 14 that can have detergent, anti-bacterial, and/or caustic properties, so as to physically and chemically remove hair, soap, fungus, mold, bacteria, calcium deposits, etc. When the pump mechanism (dispensing mechanism) 18 is operated, cleaning solution 14 is drawn up into the tube 20, and is then forced into the tube 16, which is attached via a collar 21 that anchors a proximal end of the wire cable 22 that runs within the tube 16 to the brush 24 connected to the distal end of the wire cable 22. The brush 24 can rotate 3 about the longitudinal axis of the wire cable 22.

Figure 3:
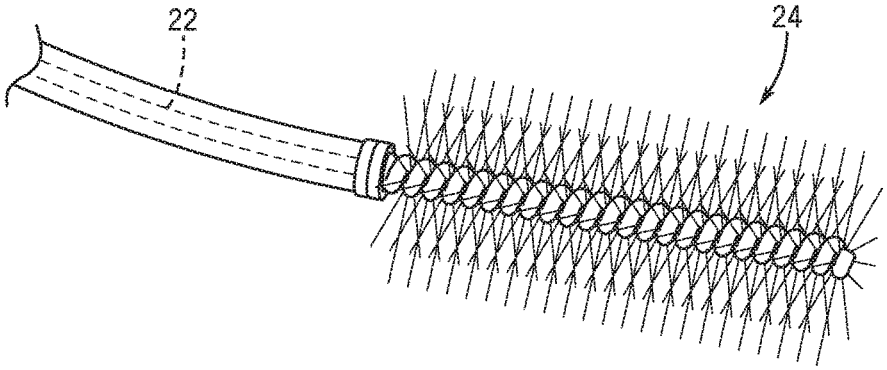
FIG. 3 is a side view of the cylindrical brush of the sink maintenance apparatus of FIG. 1.

Referring to FIG. 3, a close-up view is shown of the cleaning brush 24 at the distal end of the wire cable 22, the brush 24 being able to rotate. The brush 24 can also be in fixed relationship with the wire cable 22.

Figure 4:
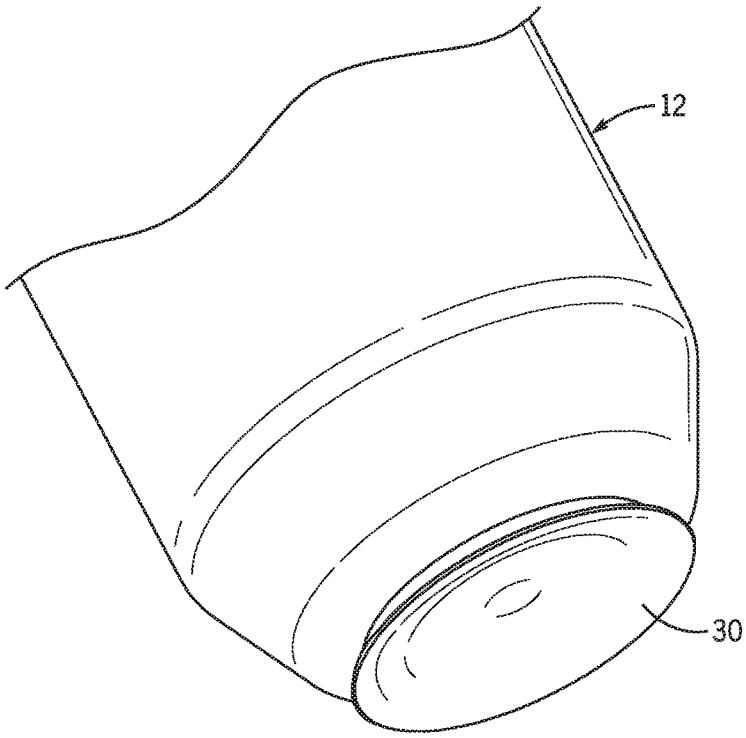
FIG. 4 is a bottom side perspective view of the bottom of sink maintenance apparatus of FIGS. 1 and 2.

Referring to FIG. 4, the bottle 12 can have a suction cup 30 on its bottom for securing the bottle to a flat surface near the sink.

Figure 5:
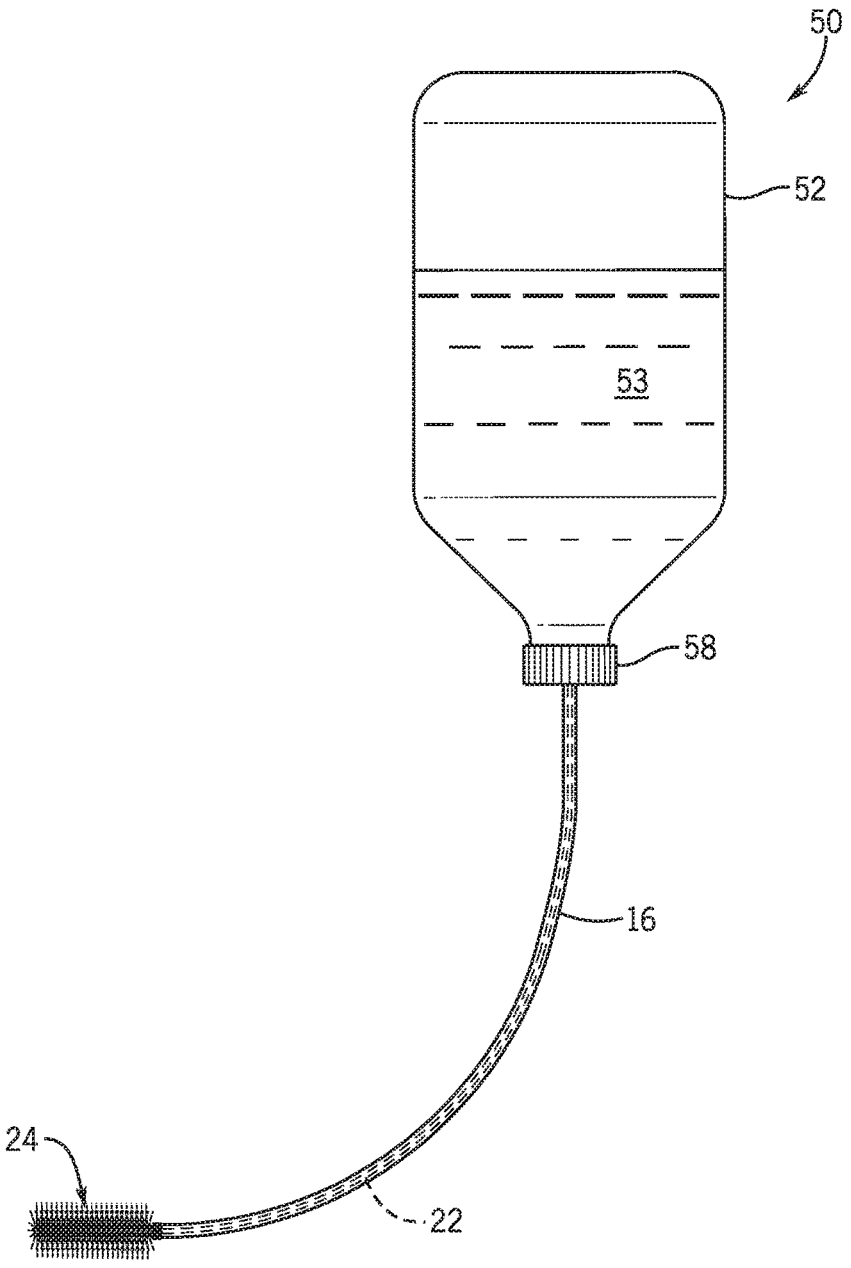
FIG. 5 is a side view of another embodiment of the invention having a squeezable container that is squeezed to push cleaning solution into the distribution tube towards the cleaning brush.

Referring to FIG. 5, the plastic bottle (squeezable cleaning fluid reservoir) 52 can be made of flexible plastic so that it can be squeezed so as to force cleaning solution 53 into the tube 16. The tube 16 can be grasped, and since there is a wire cable 22 running inside of the tube 16 along the entire length of the tube 16, the tube 16 and the wire cable 22 inside can be pushed down into a drain, or into an overflow hole, as explained above, and with reference to FIG. 6.

Other modifications and implementations will occur to those skilled in the art without departing from the spirit and the scope of the invention as claimed. Accordingly, the above description is not intended to limit the invention, except as indicated in the following claims.

What is claimed is:

1. An apparatus for cleaning and disinfecting a sink, the sink having an overflow opening and an overflow channel having a length extending between the overflow opening and a main drain, the overflow channel further having an interior diameter defining a passageway for flow of overflow fluid entering the overflow opening of the sink, the interior diameter of the overflow channel being large enough to drain off the overflow fluid from the sink at least as quickly as a faucet of the sink dispenses the fluid into the sink, the apparatus comprising:

a cleaning fluid dispenser, the dispenser having a cleaning fluid reservoir, and a reciprocating pump dispensing mechanism with a fluid dispensing port, operation of the reciprocating pump dispensing mechanism resulting in cleaning fluid being forced from the cleaning fluid reservoir and out the fluid dispensing port;

a tube sealed to and in fluid communication with the fluid dispensing port;

a support wire having a proximal end affixed to an inner surface of the fluid dispensing port, and having a cylindrical brush extending from a distal end of the support wire, the support wire running inside the tube along its length from the fluid dispensing port to the cylindrical brush, thereby being able to provide cleaning fluid to the cylindrical brush, wherein the cylindrical brush has bristles defining a diameter of the cylindrical brush, wherein the diameter of the cylindrical brush is at least as large as the interior diameter of the overflow channel, wherein the tube, the support wire, and cylindrical brush have a combined length at least equal to the length of the overflow channel; and a securement affixed to the cleaning fluid dispenser to secure the cleaning fluid dispenser to a fixed surface proximate the sink as the cylindrical brush is manipulated by a user.

2. The apparatus of claim 1, wherein the securement comprises a suction cup for affixing the cleaning fluid dispenser to the fixed surface.

3. The apparatus of claim 1, wherein the cleaning fluid reservoir holds at least 30 oz of cleaning fluid.

4. The apparatus of claim 1, wherein the cylindrical brush is reusable.

5. The apparatus of claim 1, wherein the diameter of the cylindrical brush is larger than the diameter of the overflow channel.

6. The apparatus of claim 1, wherein the tube is flexible.

7. The apparatus of claim 1, wherein the tube is made of a material that is durable under repeated use sliding in and out of the overflow opening and the overflow channel of the sink.

8. The apparatus of claim 1, wherein the wire is reinforced so as to prevent the wire from kinking while the tube is grasped and pushed into and pulled out of the overflow opening and the overflow channel of the sink.

9. An apparatus for cleaning and disinfecting a sink, the sink having an overflow opening and an overflow channel having a length extending between the overflow opening and a main drain, the overflow channel further having in interior diameter defining a passageway for flow of overflow fluid entering the overflow opening of the sink, the interior diameter of the overflow channel being large enough to drain off the overflow fluid from the sink at least as quickly as a faucet of the sink dispenses the fluid into the sink, the apparatus comprising:

a squeezable cleaning fluid reservoir with a fluid dispensing port, squeezing of the squeezable cleaning fluid reservoir resulting in cleaning fluid being forced from the cleaning fluid reservoir and out the fluid dispensing port;

a flexible tube sealed to and in fluid communication with the fluid dispensing port; and a support wire having a proximal end affixed to an inner surface of the fluid dispensing port, and having cylindrical brush attached to and extending from a distal end of the support wire, the support wire running inside the tube along its length from the fluid dispensing port to a cylindrical brush, thereby being able to provide cleaning fluid to the cylindrical brush, wherein the cylindrical brush has bristles defining a diameter of the cylindrical brush, wherein the diameter of the cylindrical brush is at least as large as the interior diameter of the overflow channel, wherein the tube, the support wire, and cylindrical brush have a combined length at least equal to the length of the overflow channel; and a securement affixed to the squeezable cleaning fluid reservoir to secure the squeezable cleaning fluid reservoir to a fixed surface proximate the sink as the cylindrical brush is manipulated by a user.

10. The apparatus of claim 9, wherein the securement comprises a suction cup for affixing the dispenser to the fixed surface.

11. The apparatus of claim 9, wherein the squeezable cleaning fluid reservoir holds at least 30 oz of cleaning fluid.

12. The apparatus of claim 9, wherein the cylindrical brush is of a diameter slightly larger than the diameter of the overflow channel.

13. The apparatus of claim 9, wherein the flexible tube is made of a material that is durable under repeated use sliding in and out of the overflow opening and the overflow channel of the sink.

14. The apparatus of claim 9, wherein the wire is reinforced so as to prevent the wire from kinking while the flexible tube is grasped and pushed into and pulled out of the overflow opening and the overflow channel of the sink.

* * * * *